US008657022B2

(12) United States Patent
Smith et al.

(10) Patent No.: US 8,657,022 B2
(45) Date of Patent: Feb. 25, 2014

(54) FIRE SUPPRESSION SYSTEM

(75) Inventors: Paul D. Smith, Brighton (GB); Robert G. Dunster, Slough (GB); Paul Rennie, Bracknell (GB); Beth A. Jones, Hook (GB)

(73) Assignee: Kidde Technologies, Inc., Wilson, NC (US)

( * ) Notice: Subject to any disclaimer, the term of this patent is extended or adjusted under 35 U.S.C. 154(b) by 941 days.

(21) Appl. No.: 12/721,828

(22) Filed: Mar. 11, 2010

(65) Prior Publication Data

US 2011/0083864 A1 Apr. 14, 2011

(30) Foreign Application Priority Data

Oct. 8, 2009 (GB) ..... 0917666.0

(51) Int. Cl.
*A62C 3/07* (2006.01)

(52) U.S. Cl.
USPC ..... 169/62; 169/11; 169/19; 169/26; 169/60; 169/70

(58) Field of Classification Search
USPC ..... 169/5, 9, 11, 19, 54, 56, 60, 62, 70, 26
See application file for complete search history.

(56) References Cited

U.S. PATENT DOCUMENTS

| | | | | |
|---|---|---|---|---|
| 2,252,163 | A | 8/1941 | Burger | |
| 2,357,133 | A | 4/1944 | Rider | |
| 3,171,493 | A | 3/1965 | Barr | |
| 3,464,497 | A * | 9/1969 | Globerman et al. | 169/60 |
| 3,568,774 | A | 3/1971 | Meoule | |

(Continued)

FOREIGN PATENT DOCUMENTS

| | | |
|---|---|---|
| GB | 2252163 | 7/1992 |
| JP | 58-51390 | 4/1983 |
| WO | 2006130363 A2 | 12/2006 |

OTHER PUBLICATIONS

Examination Report dated Sep. 5, 2012 for Australia Patent Application No. 2010226971.

(Continued)

*Primary Examiner* — Steven J Ganey
(74) *Attorney, Agent, or Firm* — Carlson, Gaskey & Olds, P.C.

(57) ABSTRACT

A fire detection system includes a detection tube and a sensing device. The detection tube contains a sensing fluid having a first physical condition and a second physical condition. The sensing fluid is in the first physical condition below a temperature threshold, and is in the second physical condition above the temperature threshold. The sensing fluid is at least partially liquid in the first physical condition. The sensing device is movable to open in response to a transition of a portion of the sensing fluid from the first physical condition to the second physical condition.

12 Claims, 6 Drawing Sheets

(56) References Cited

U.S. PATENT DOCUMENTS

| | | | | |
|---|---|---|---|---|
| 3,593,801 | A | | 7/1971 | DePalma |
| 3,802,510 | A | | 4/1974 | Johnson |
| 4,282,931 | A | * | 8/1981 | Golben ..... 169/9 |
| 4,305,469 | A | | 12/1981 | Morrisette |
| 4,637,473 | A | | 1/1987 | Gillis et al. |
| 4,688,183 | A | | 8/1987 | Carll et al. |
| 5,172,099 | A | | 12/1992 | Glaser |
| 5,458,202 | A | | 10/1995 | Fellows et al. |
| 5,590,718 | A | | 1/1997 | Bertossi |
| 5,908,074 | A | | 6/1999 | Potts |
| 5,934,379 | A | | 8/1999 | Ostlyngen et al. |
| 6,209,654 | B1 | | 4/2001 | Curless |
| 6,612,373 | B2 | | 9/2003 | Brennan |
| 2006/0278412 | A1 | | 12/2006 | Hodges et al. |

OTHER PUBLICATIONS

JP Office Action (translation), dated Apr. 23, 2012, JP Application No. 2010-224463.

UK Search Report, dated Feb. 9, 2010.

Canadian Office Action for Canadian Application No. 2715421 dated Jan. 30, 2013.

* cited by examiner

FIRE SUPPRESSION SYSTEM

RELATED APPLICATION

This application claims priority to GB patent application number 0917666.0, which was filed Oct. 10, 2009.

BACKGROUND OF THE INVENTION

This disclosure relates to heat detection, and more particularly to a fire detection system.

Systems exist that detect heat in or around a vehicle and distribute fire suppressant if the detected heat represents a fire. These systems may direct the fire suppressant to tires, for example, to suppress tire fires. Such systems have utilized self-destructing fire detection mechanisms to detect heat. For example, the mechanism may melt or burst in response to heat in order to trigger release of the fire suppressant. Such systems and mechanisms are therefore not reusable.

SUMMARY OF THE INVENTION

A disclosed fire detection system includes a detection tube and a sensing device. The detection tube contains a sensing fluid having a first physical condition and a second physical condition. The sensing fluid is in the first physical condition below a temperature threshold, and is in the second physical condition above the temperature threshold. The sensing fluid is at least partially liquid in the first physical condition. The sensing device is movable to open in response to a transition of a portion of the sensing fluid from the first physical condition to the second physical condition.

These and other features of the present disclosure can be best understood from the following specification and drawings, the following of which is a brief description.

DETAILED DESCRIPTION OF THE PREFERRED EMBODIMENT

Figure 1:
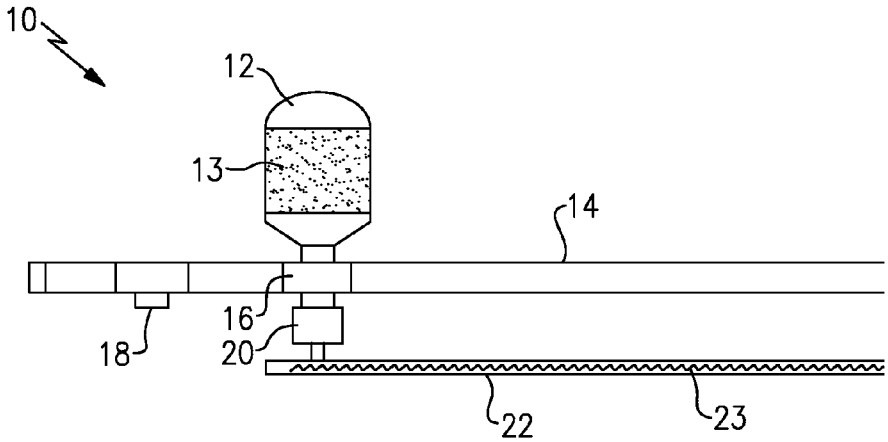
FIG. 1 schematically illustrates a fire detection system.

FIG. 1 schematically illustrates a fire detection system 10 that includes a detection tube 22 and a valve 16. The detection tube 22 contains a sensing fluid 23 having a first physical condition and a second physical condition. The sensing fluid 23 is in the first physical condition when below a temperature threshold, and is in the second physical condition when above the temperature threshold. Although in the embodiment of FIG. 1 the fire suppression system 10 has additional components, in some regard those components may be optional, and may have other structures from those shown in the example of FIG. 1.

A cylinder 12 containing a fire suppressant 13 is operable to distribute the fire suppressant 13 through a distribution tube 14 via the release valve 16. Some example fire suppressants include the following: gaseous agents including inert gases (e.g. $CO_2$ or $N_2$), Halon's (e.g., Halon 1211 or Halon 1301), hydrofluorocarbons (HFC's) (e.g. FM200® also known as heptafluoropropane, and FE36® also known as hexafluoropropane), per fluorocarbons (PFC's) (e.g. Novec1230® also known as per fluorinated ketone), and dry chemical powders (e.g. BC powders or ABC powders). The fire suppressant 13 could also include a foam, such as fluoroprotein ("FP") foam, film-forming fluoroprotein ("FFFP") foam, aqueous film-forming foam (AFFF), or alcohol resistant foams (e.g. AR-AFFF or AR-FFFP). Of course, other fire suppressants could be used.

The distribution tube 14 includes a nozzle 18 through which the fire suppressant 13 can be emitted. In one example, the distribution tube 14 may be made from stainless steel or other ferrous or non-ferrous metal or metal alloys. Of course, the distribution tube 14 could be constructed from other materials. The release valve 16 rests in a closed position until it is opened by release valve actuation assembly 20, which will be described in greater detail below.

As described above, the detection tube 22 contains a sensing fluid 23. In one example the sensing fluid 23 includes a single component, such as a gas or a liquid. In one example the sensing fluid 23 includes a multiple component mixture, such as a gas dissolved in a liquid. When contained within a restricted volume, such as the detection tube 22, the sensing fluid 23 exhibits a rapid increase in the rate of change of pressure as a function of temperature when heated above a temperature threshold.

Figure 2:
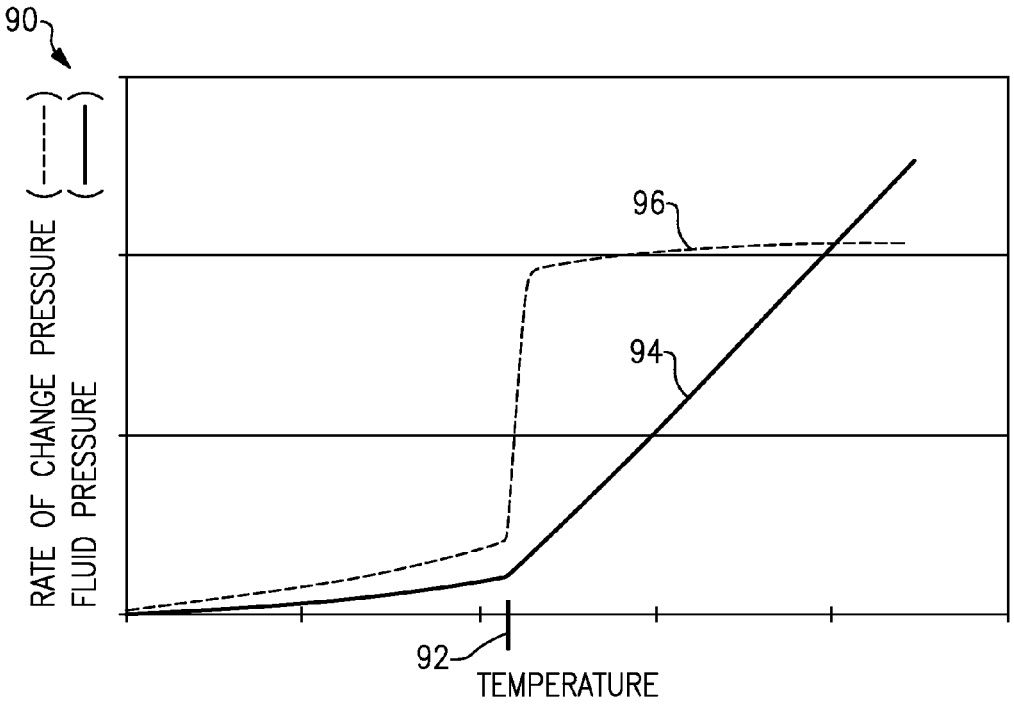
FIG. 2 is a graph showing an example of how fluid pressure and a rate of change of fluid pressure of a sensing fluid may vary with temperature.

FIG. 2 is a graph 90 showing an example of how fluid pressure 94 and a rate of change of fluid pressure 96 of the sensing fluid 23 may vary with temperature. As shown in FIG. 2, at the temperature threshold 92, fluid pressure 94 increases and the rate of change of fluid pressure 96 increases. The rapid increase in rate of change of pressure actuates the actuation assembly 20. In one example, the sensing fluid 23 is selected to have an associated rate of change of pressure such that the sensing device is movable to open if only a portion of the sensing fluid 23 (e.g., at least 10% of the sensing fluid 23) is above the temperature threshold.

In one example, the sensing fluid 23 is selected so that in the first physical condition the sensing fluid 23 or a component of the sensing fluid 23 is below an associated critical temperature, and in the second physical condition the sensing fluid 23 is above the critical temperature, or close to being above the critical temperature. In one example, the sensing fluid 23 is selected so that in the first physical condition a gas is dissolved in the sensing fluid, and in the second physical condition the gas is driven out of the sensing fluid. Of course, various combinations of the described sensing fluids 23 could be used, and other sensing fluids not discussed could also be used.

As discussed above, the sensing fluid 23 is selected such that the pressure in the detection tube 22 increases beyond the predefined pressure threshold 92 in response to a heating event (e.g. a fire) that exceeds a predefined temperature associated with a fire threat in proximity to the detection tube 22. In one example the detection tube 22 is made from a base metal, such as stainless steel, copper, brass, or aluminum. Of course, other metals, or even non-metals, could be used. The detection tube 22 and the sensing fluid 23 within the detection tube 22 are fully reusable through multiple cycles of physical condition changes or multiple emissions of fire suppressant 13, and do not require melting or bursting, for example.

Figure 3:
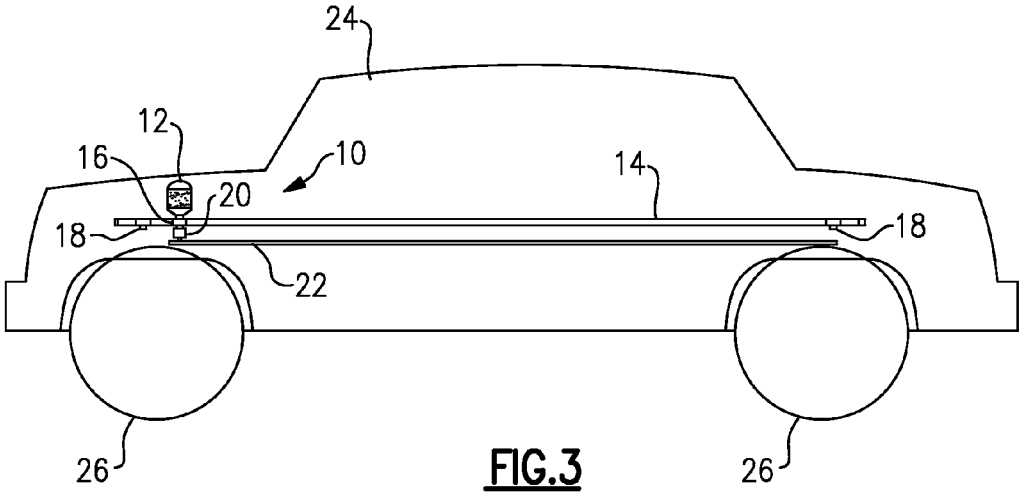
FIG. 3 schematically illustrates the fire detection system of FIG. 1 in an automobile environment.

FIG. 3 schematically illustrates the fire suppression system 10 of FIG. 1 in the environment of an automobile 24 having tires 26. The detection tube 22 is arranged in proximity to the tires 26 such that if heat from the tires 26 exceeds the threshold temperature of the sensing fluid 23, the sensing fluid 23 will change physical conditions and cause the pressure of the sensing fluid 23 in detection tube 22 to increase beyond the predefined pressure threshold, causing the release valve actuation assembly 20 to actuate valve 16. Actuation of valve 16 causes fire suppressant to flow from cylinder 12 through distribution tube 14 to nozzles 18.

The nozzles 18 may be configured to distribute fire suppressant to a safety area. Referring to FIG. 3, the safety area may be in proximity to tires 26, for example. However, it is to be understood that even though FIG. 3 schematically illustrates an tire safety area, other configurations, such as nozzles configured to cool an engine, or non-automobile applications, would be possible.

Figure 4A:
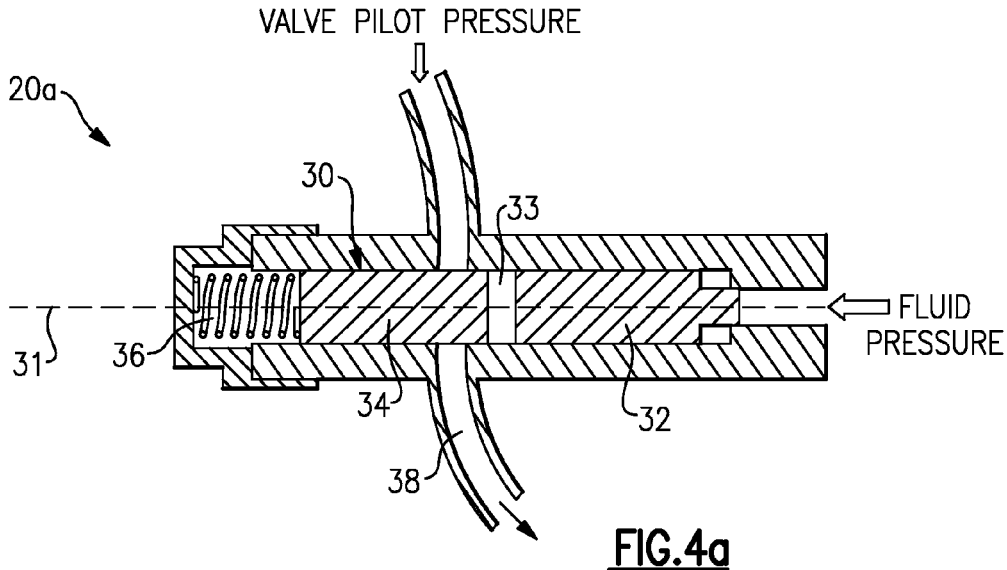
FIG. 4*a* schematically illustrates a first example release valve actuation assembly in an un-actuated position.

FIG. 4*a* schematically illustrates a first example release valve actuation assembly 20*a* in an un-actuated position. The assembly 20*a* is designed for use with a pressure-piloted valve, such as the Kidde Fenwal Wet Chemical Valve (available under part number 87-12009-001), which is schematically illustrated in FIG. 5.

Figure 4B:
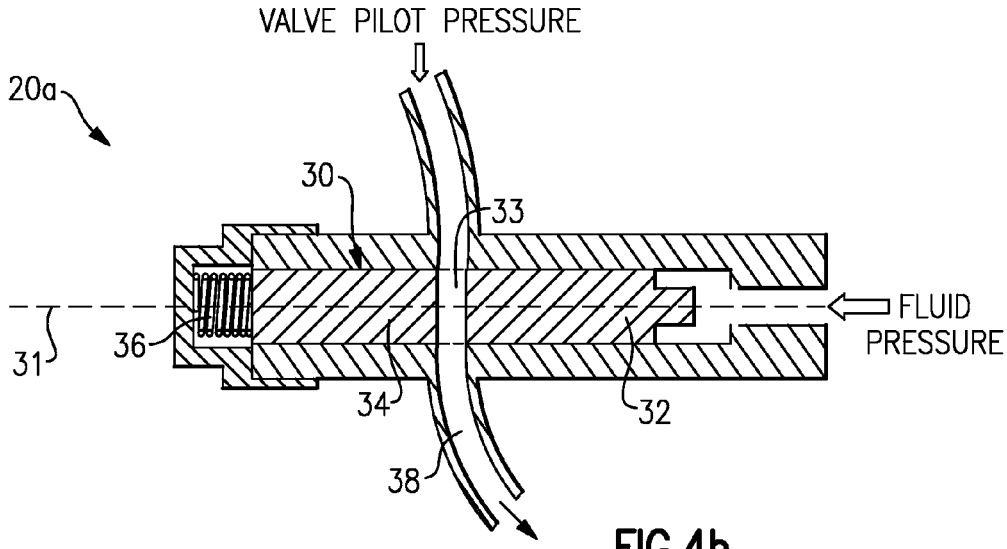
FIG. 4*b* schematically illustrates the release valve actuation assembly of FIG. 4*a* in an actuated position.

The assembly 20*a* includes a pin 30 that is movable along an axis 31 between a first position (see FIG. 4*a*) and a second position (see FIG. 4*b*). The pin 30 includes a first portion 32, a second portion 34, and a channel 33 extending between the portions 32, 34. The sensing fluid 23 in the detection tube 22 applies pressure to the pin 30. When the pressure within detection tube 22 increases beyond a predefined pressure threshold, the pin 30 compresses the bias member 36 to align the channel 33 with pilot pressure channel 38 (see FIG. 4*b*). Once this alignment occurs, the pilot pressure channel 38 applies pressure to the valve 16, which releases fire suppressant. The pilot pressure channel 38 may apply pressure, for example, by permitting a flow of a fluid through the channel 38.

Figure 5:
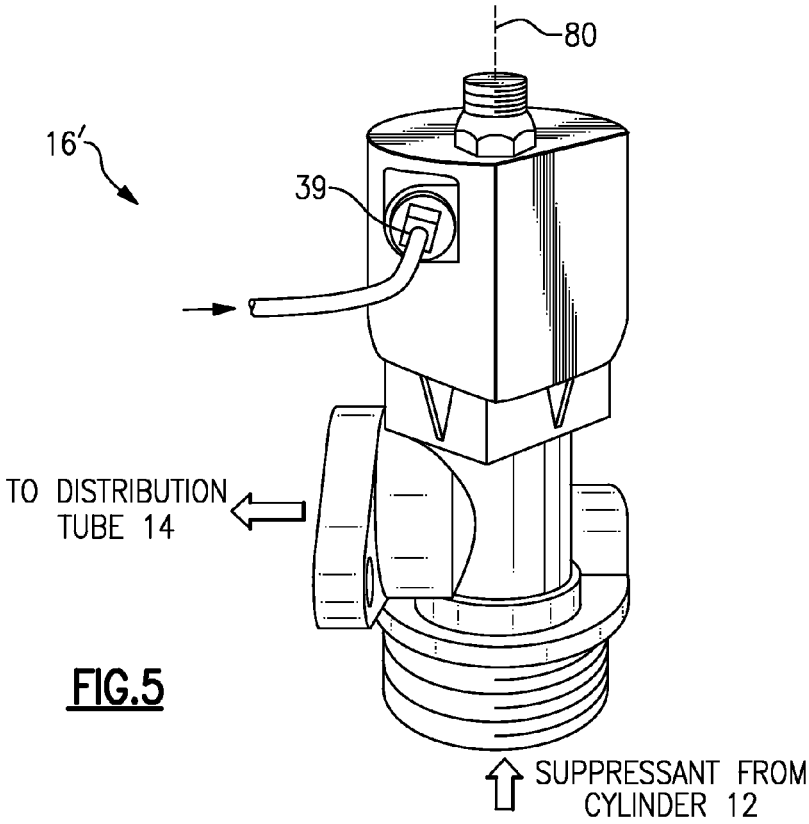
FIG. 5 schematically illustrates an example valve compatible with the valve actuation assembly of FIGS. 4*a-b*.

Referring to FIG. 5, valve 16' includes a pilot pressure inlet port 39 that is operable to receive a pilot pressure. The pilot pressure, if sufficient, moves a valve mechanism (not shown) within the valve 16' along axis 80, to permit a flow of fire suppressant through the valve 16'. Of course, it is to be understood that other pressure-piloted valves may alternatively be used with the assembly 20*a*.

In one example, as the temperature of the detection tube 22 lowers beneath the threshold temperature (indicating, for example, that a fire has been extinguished), the pressure in the detection tube 22 decreases below the pressure threshold, allowing the bias member 36 to expand and move pin 32 back to the first position (see FIG. 4*a*), thus closing the release valve 16.

Figure 6A:
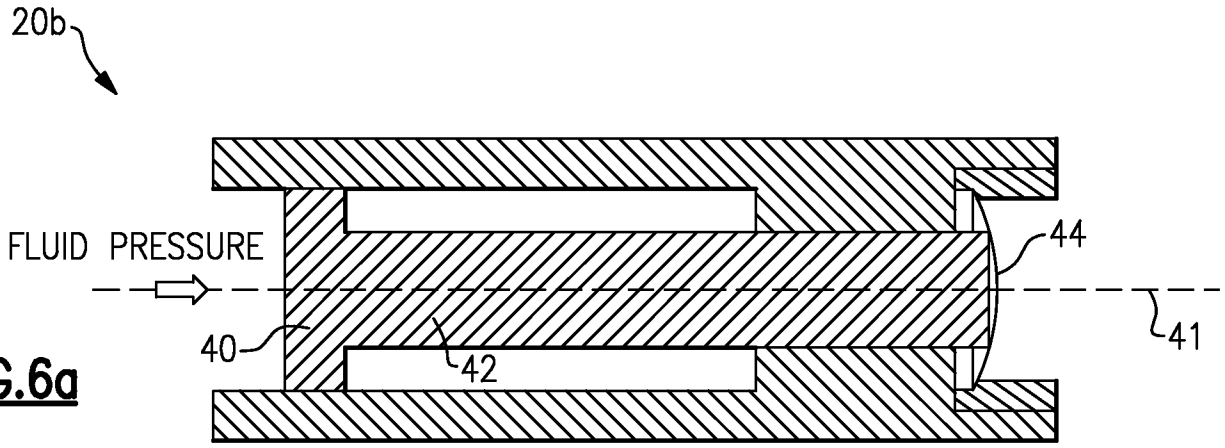
FIG. 6*a* schematically illustrates another example release valve actuation assembly in an un-actuated position.
Figure 6B:
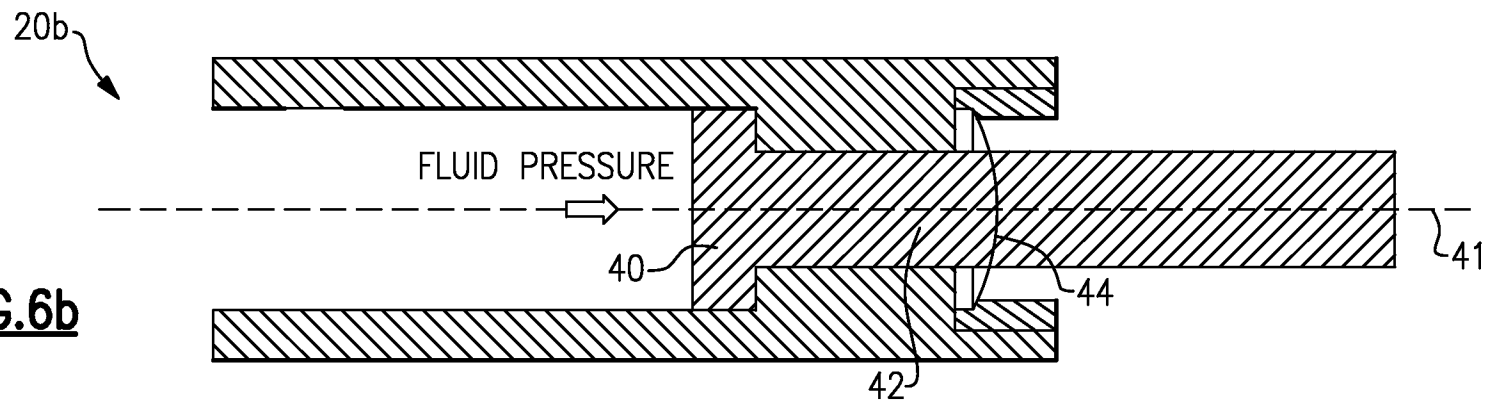
FIG. 6*b* schematically illustrates the release valve actuation assembly of FIG. 6*a* in an actuated position.
Figure 7A:
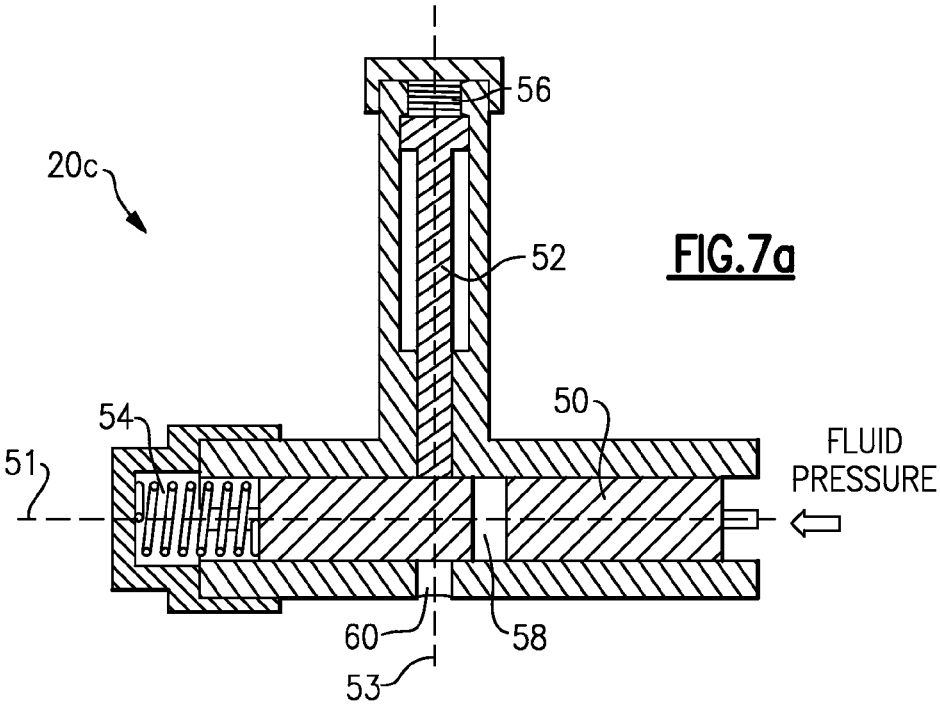
FIG. 7*a* schematically illustrates another example release valve actuation assembly in an un-actuated position.
Figure 7B:
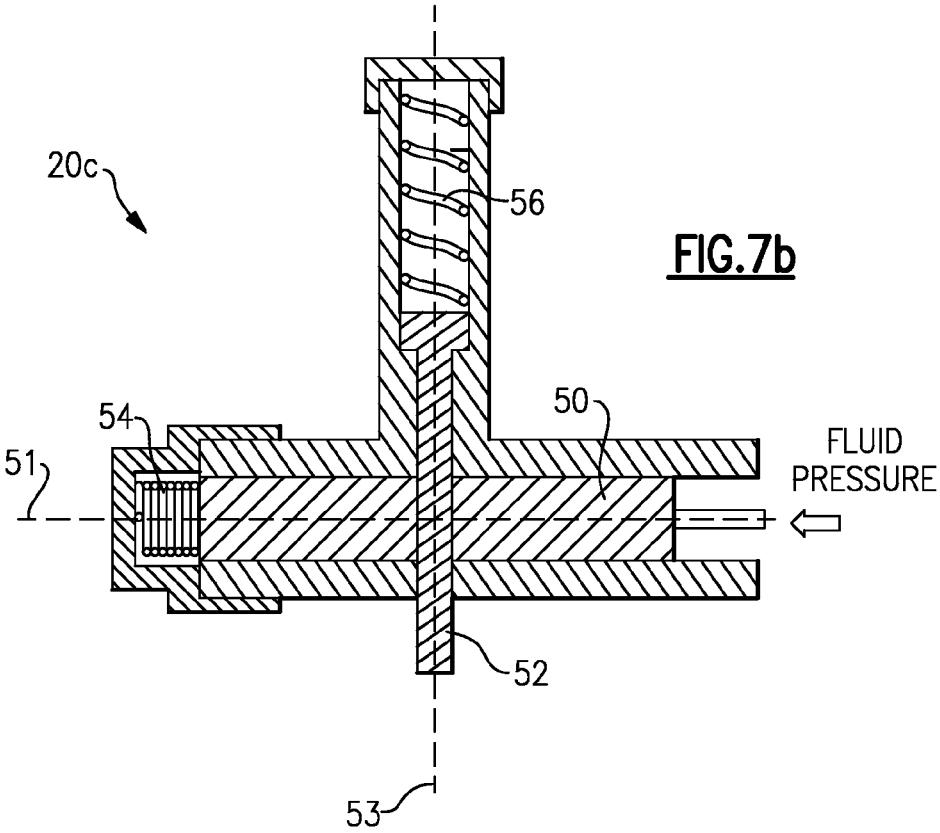
FIG. 7*b* schematically illustrates the release valve actuation assembly of FIG. 7*a* in an actuated position.
Figure 8:
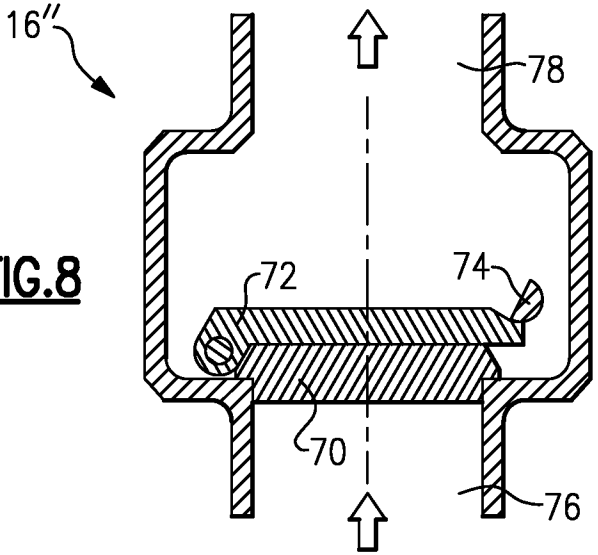
FIG. 8 schematically illustrates an example valve compatible with the valve actuation assemblies of FIGS. 6*a-b* and 7*a-b*.

FIGS. 6*a-b* and 7*a-b* schematically illustrate example release valve actuation assemblies 20*b-c* for use with force-driven piston or pin-actuated valves, such as the valve of FIG. 8. FIG. 6*a* schematically illustrates a release valve actuation assembly 20*b* in an un-actuated position. The assembly 20*b* includes a pin 42 that may be used to apply the required force to operate the valve actuation assembly 20*b*. The pin 40 is movable along an axis 41 between a first position (see FIG. 6*a*) and a second position (see FIG. 6*b*). When pressure within the detection tube 22 increases beyond the predefined pressure threshold, the pressure applied to the head 40 of the pin 42 is great enough to rupture a diaphragm 44, forcing the pin 42 past the diaphragm 44 (see FIG. 6*b*). The release valve actuation assembly 20*b* can be configured such that the pin 42 passing past the diaphragm 44 actuates the valve 16 in a similar manner to a traditional force-driven piston or pin actuator. The diaphragm 44 may comprise a ferrous or non-ferrous metal, or a ferrous or non-ferrous metal alloy, for example, such that the diaphragm 44 bursts at the predefined pressure threshold. Of course, other materials could be used for the diaphragm. Thus, even though in the embodiment of FIGS. 6*a-b* the diaphragm 44 may need to be replaced after the diaphragm 44 ruptures, the detection tube 22 and the sensing fluid 23 within the detection tube 22 are fully reusable, and the process of fire detection within the fire suppression system 10 does not require melting or bursting.

FIG. 7*a* schematically illustrates an example release valve actuation assembly 20*c* in an un-actuated position. In the example of FIG. 7*a*, the assembly 20*c* includes multiple actuation pins 50, 52 each movable between a first position (see FIG. 7*a*) and a second position (see FIG. 7*b*). Pin 50 is movable along axis 51, and is in contact with bias member 54. Pin 52 is movable along axis 53 and is in contact with bias member 56. When the pressure within detection tube 22 increases beyond the predefined pressure threshold, the pin 50 compresses the bias member 54 until the bias member 54 is compressed and the opening 60 is aligned with the channel 58 in the pin 50. Once this alignment occurs, bias member 56 expands to push the pin 52 through channels 58, 60 (see FIG. 6*b*).

Although bias member 36 is illustrated in the assembly 20*a* as being a spring and bias members 54, 56 are illustrated in the assembly 20*c* as being springs, it is understood that the bias members 36, 54, 56 could be replaced with any other mechanism capable of delivering an actuating or resisting force. For example, a compressed gas, or any number of other mechanisms, could be used as a replacement for the bias members 36, 54, 56.

FIG. 8 schematically illustrates a flapper valve 16". The flapper valve 16" rests in a closed position, and is held in the closed position by a bore plug 70. The bore plug 70 is held in place by a beam 72 which is held in position by an operating spindle 74. An operating arm (not shown) is attached to the operating spindle 74. When a force (e.g. movement of pin 40 or 52) is applied to the operating arm, the operating spindle 74 rotates allowing movement of the beam 72, which releases the bore plug 70 and permits a flow of fire suppressant from a valve inlet 76 to a valve outlet 78.

Figure 9:
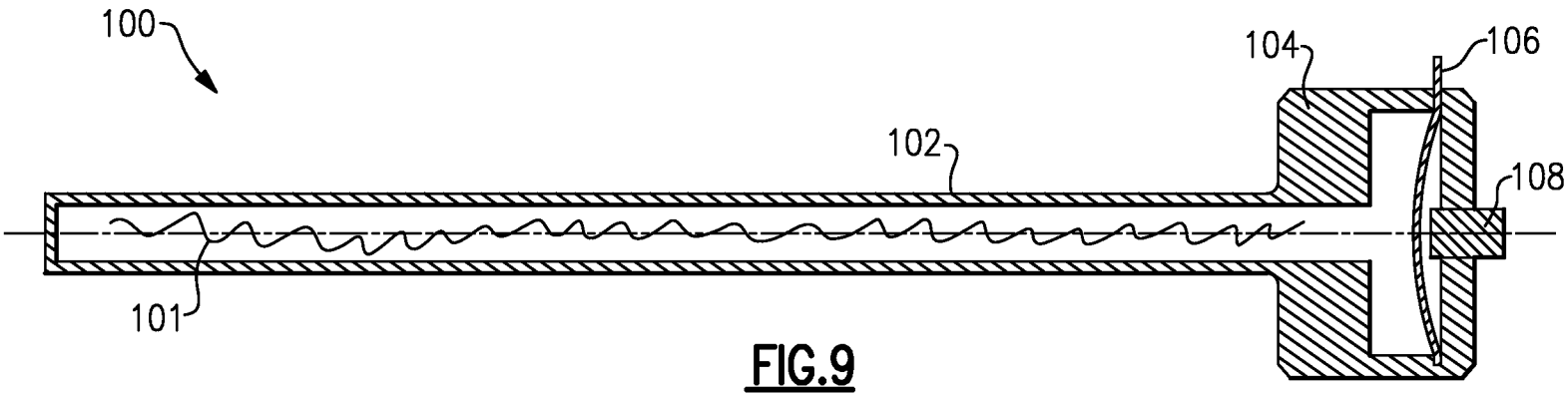
FIG. 9 schematically illustrates a fire notification assembly.

FIG. 9 schematically illustrates a fire notification assembly 100. A normally open (OFF) pressure switch 104 includes a flexible diaphragm 106 and a contact pin 108. As fluid pressure of sensing fluid 101 within the restricted volume of the detection tube 102 increases beyond the predefined pressure threshold, the flexible diaphragm 106 is deflected towards the contact pin 108, which closes (turns ON) the switch 104 to actuate a notification (e.g. a fire alarm). Of course, other configurations would be possible. In one example the fire notification assembly 100 could omit the flexible diaphragm 106, and the contact pin 108 could be replaced with a pressure transducer or a piezo-resistive device.

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. A fire detection system, comprising:

a detection tube containing a sensing fluid having a first physical condition and a second physical condition, the sensing fluid being in the first physical condition below a temperature threshold and being in the second physical condition above the temperature threshold, wherein the sensing fluid is inescapably sealed within the detection tube, and wherein the sensing fluid is at least partially liquid in the first physical condition; and a sensing device movable to open in response to a transition of a portion of the sensing fluid from the first physical condition to the second physical condition and moveable from open in response to a transition of a portion of the sensing fluid from the second physical condition to the first physical condition, the sensing device corresponding to a fire suppressant valve assembly that includes an actuation portion having a pin that is movable from a first position to a second position in response to a pressure increase from a transition between the first physical condition and the second physical condition, and the fire suppressant valve assembly opens in response to the actuation portion being moved to the second position, the pin including a first end in fluid contact with the sensing fluid and a second end in contact with a bias member, and an opening of the pin aligns with a pilot pressure channel when the pin is in the second position such that fluid can pass through the pin in the second position to move the fire suppressant valve assembly.

2. The system of claim 1, wherein the detection tube forms a restricted volume within which the sensing fluid is inescapably sealed, and wherein the detection tube is reusable through multiple cycles of physical condition changes.

3. The system of claim 1, wherein the sensing fluid exhibits a rapid increase in the rate of change of pressure as a function of temperature above the temperature threshold, such that the sensing device is movable to open if only a portion of the sensing fluid is above the temperature threshold.

4. The system of claim 1, wherein the detection tube is sealed, such that the sensing fluid can repeatedly transition between the first physical condition and the second physical condition within the detection tube.

5. The system of claim 1, wherein the pin is movable to close the fire suppressant valve in response to the transition from the second physical condition to the first physical condition.

6. The system of claim 1, wherein the sensing device corresponds to a fire notification assembly that includes a flexible diaphragm and a contact pin, wherein the diaphragm is movable from a first position to a second position in response to the transition between the first physical condition and the second physical condition, such that the flexible diaphragm actuates the contact pin in the second physical condition to issue a fire notification, or where the sensing device includes a piezo-resistive device or pressure transducer such that the piezo-resistive device or pressure transducer triggers a fire notification in the second physical condition.

7. The system of claim 1, further comprising:

a container of fire suppressant; and a suppressant distribution channel arranged to receive the fire suppressant from the container through the sensing device.

8. The system of claim 1, wherein in the first physical condition the sensing fluid has a first rate of change of pressure with respect to temperature, and in the second physical condition the sensing fluid has a second rate of change of pressure with respect to temperature that is greater than the first rate of change of pressure.

9. The system of claim 1, wherein the temperature threshold corresponds to a critical temperature of either the sensing fluid or a component of the sensing fluid, and wherein in the first physical condition the sensing fluid is below the critical temperature, and in the second physical condition the sensing fluid is above the critical temperature.

10. The system of claim 1, and wherein in the first physical condition a gas is dissolved in the sensing fluid, and in the second physical condition the gas is driven out of the sensing fluid.

11. The system of claim 1, wherein the detection tube comprises at least one of stainless steel, copper, brass, or aluminum.

12. A fire detection system, comprising:

a detection tube containing a sensing fluid having a first physical condition and a second physical condition, the sensing fluid being in the first physical condition below a temperature threshold and being in the second physical condition above the temperature threshold, wherein the sensing fluid is inescapably sealed within the detection tube, and wherein the sensing fluid is at least partially liquid in the first physical condition;

a sensing device movable to open in response to a transition of a portion of the sensing fluid from the first physical condition to the second physical condition;

a first pin that is movable from a first position to a second position in response to the transition between the first physical condition and the second physical condition, a first end of the first pin being in fluid contact with the sensing fluid, and a second end of the first pin being in contact with a first bias member; and a second pin, a first end of the second pin being in contact with the first pin, and a second end of the second pin being in contact with a second bias member such that the second pin extends through a channel in the first pin to actuate the fire suppressant valve assembly when the first pin is in the second position.

* * * * *

UNITED STATES PATENT AND TRADEMARK OFFICE

CERTIFICATE OF CORRECTION

PATENT NO. : 8,657,022 B2
APPLICATION NO. : 12/721828
DATED : February 25, 2014
INVENTOR(S) : Smith et al.

It is certified that error appears in the above-identified patent and that said Letters Patent is hereby corrected as shown below:

IN THE CLAIMS:

Claim 12, column 6, line 53: replace “the” with --a-- (First Occurrence)

Signed and Sealed this
Twenty-seventh Day of May, 2014

Michelle K. Lee

Michelle K. Lee
*Deputy Director of the United States Patent and Trademark Office*